US009702262B2

(12) United States Patent
Brandl et al.

(10) Patent No.: US 9,702,262 B2
(45) Date of Patent: Jul. 11, 2017

(54) STATOR COMPONENT WITH SEGMENTED INNER RING FOR A TURBOMACHINE

(71) Applicant: ALSTOM Technology Ltd, Baden (CH)

(72) Inventors: Herbert Brandl, Waldshut-Tiengen (DE); Hans-Peter Bossmann, Lauchringen (DE)

(73) Assignee: ANSALDO ENERGIA IP UK LIMITED, London (GB)

( * ) Notice: Subject to any disclaimer, the term of this patent is extended or adjusted under 35 U.S.C. 154(b) by 398 days.

(21) Appl. No.: 14/335,203

(22) Filed: Jul. 18, 2014

(65) Prior Publication Data

US 2014/0328672 A1 Nov. 6, 2014

Related U.S. Application Data

(63) Continuation of application No. PCT/EP2013/051508, filed on Jan. 25, 2013.

(30) Foreign Application Priority Data

Jan. 26, 2012 (EP) ..... 12152718

(51) Int. Cl.
*F01D 11/18* (2006.01)
*F01D 9/04* (2006.01)
(Continued)

(52) U.S. Cl.
CPC ..... *F01D 11/18* (2013.01); *F01D 9/04* (2013.01); *F01D 11/08* (2013.01); *F01D 11/122* (2013.01);
(Continued)

(58) Field of Classification Search
CPC ..... F01D 11/08; F01D 11/122; F01D 11/127; F05D 2240/11; F05D 2300/2118;
(Continued)

(56) References Cited

U.S. PATENT DOCUMENTS 3,854,843 A 12/1974 Penny
4,289,447 A 9/1981 Sterman et al.
(Continued)

FOREIGN PATENT DOCUMENTS

EP 1 225 308 B1 3/2005
EP 1 764 479 A1 3/2007
(Continued)

*Primary Examiner* — Ninh H Nguyen
(74) *Attorney, Agent, or Firm* — Buchanan Ingersoll & Rooney PC

(57) ABSTRACT

A stator component of a turbomachine includes at least one axially extending outer ring which serves as a frame of an inner ring composed of partial segments. The partial segments are arranged on one another such that, on the rotor side, to form a coherent circular circumferential surface in relation to the rotational movement of rotor blades. The individual partial segment is composed of a material of uniform construction or, at least in a radial direction, of multiple partial bodies constructed from different materials, such as for example ceramic, wherein a partial segment thus formed exhibits predetermined stress and/or expansion behavior as a function of the load ranges of the turbomachine.

22 Claims, 4 Drawing Sheets

(51) Int. Cl.
*F01D 11/08* (2006.01)
*F01D 25/24* (2006.01)
*F01D 11/12* (2006.01)

(52) U.S. Cl.
CPC ..... *F01D 25/246* (2013.01); *F05D 2240/11* (2013.01); *F05D 2240/55* (2013.01); *F05D 2260/30* (2013.01); *F05D 2300/20* (2013.01); *F05D 2300/21* (2013.01); *F05D 2300/2112* (2013.01); *F05D 2300/2118* (2013.01); *F05D 2300/50212* (2013.01)

(58) Field of Classification Search
CPC ... F05D 2300/2112; F05D 2300/50211; F05D 2300/50212
See application file for complete search history.

(56) References Cited

U.S. PATENT DOCUMENTS 4,596,116 A 6/1986 Mandet et al.
4,650,395 A * 3/1987 Weidner ..... F01D 11/08 415/115
4,679,981 A 7/1987 Guibert et al.
6,702,550 B2 * 3/2004 Darkins, Jr. ..... F01D 9/04 415/116
7,128,522 B2 * 10/2006 Jutras ..... F01D 11/006 277/359
8,206,085 B2 * 6/2012 Ammann ..... F01D 9/04 415/136
8,206,092 B2 * 6/2012 Tholen ..... F01D 11/025 415/173.1
2007/0258809 A1 11/2007 Mazzola et al.
2010/0061847 A1 * 3/2010 Welch ..... F01D 5/282 415/200
2010/0092281 A1 4/2010 Habarou et al.

FOREIGN PATENT DOCUMENTS

EP 1 890 010 A2 2/2008
EP 2 525 045 A2 11/2012
GB 2 076 475 A 12/1981
JP S63-055308 3/1988
JP H09-264104 10/1997
JP 2008-309051 12/2008
JP 2010-216473 9/2010
JP 2011-241805 12/2011
WO 2009/126191 A2 10/2009

* cited by examiner

STATOR COMPONENT WITH SEGMENTED INNER RING FOR A TURBOMACHINE

CROSS-REFERENCE TO RELATED APPLICATIONS

This application claims priority to PCT/EP2013/051508 filed Jan. 25, 2013, which claims priority to European application 12152718.8 filed Jan. 26, 2012, both of which are hereby incorporated in their entireties.

TECHNICAL FIELD

The present invention relates to a stator component for a turbomachine according to the preamble of claim 1.

BACKGROUND

A turbine housing for a combustion machine, which is substantially formed from a hot gas duct through which the hot working gases flow, is known from the prior art. Because of such operation, a cladding made of a heat-resistant material is preferably provided on the inner wall surface of this hot gas duct in order to prevent the remaining metal surface of the housing from coming into direct contact with the hot working gases. This heat protection cladding conventionally consists of a plurality of partial segments which are arranged in the circumferential direction on the inner surface of the turbine housing, such that they form a ring in and of themselves. So as to avoid problems of thermal expansion at high temperatures, the respective partial segments are spaced apart from one another in the circumferential direction.

A turbine housing known from EP 1 225 308 B1 consists of a segmented ring having a plurality of split partial segments which are arranged on the inner wall of the gas turbine housing, at predetermined intervals in the circumferential direction, such that the partial segments form a ring which is in operative connection with the rotor blades. Each of the partial segments has, in the circumferential direction, two end faces which face the ends of the adjacent partial segments. In this context, at least one of the end faces of the partial segment has a transition surface which is in the form of a cylindrical or spherical surface. The purpose of this publication is not therefore to attack the spacing of the individual partial segments with respect to one another, as known from the prior art, but to provide a different design for the transitions of the individual end faces of the partial segments in the circumferential direction, with the aim of having an effect on the gap flow with respect to the rotor blades.

SUMMARY

The invention is intended to remedy this. The invention, as it is characterized in the claims, is based on the object of proposing a stator component in which a special spacing of the individual partial segments with respect to one another in the circumferential direction and with respect to the rotor blade tips, in particular the embodiment of the rotor-side surface of the partial segments, can be dispensed with. It is also an object of the invention to propose a configuration and arrangement of the partial segments in which the problems of thermal expansions and compressive stresses can be solved in a simple manner.

In this context, the stator component for a turbomachine is embodied such that it consists substantially of an outer ring and an inner ring, wherein the outer ring serves as a holder for the inner ring formed of individual partial segments. The partial segments are arranged in relation to one another such that they form, encompassed by the outer ring, a cohesive circular circumferential surface on the rotor side. These partial segments of the inner ring have in the radial direction, i.e. in the installed state in a turbomachine in a section perpendicular to the axis of rotation of the turbomachine, a trapezoidal or quasi-trapezoidal cross section, wherein the parallel or quasi-parallel sides of the trapezium respectively form the radially inner and radially outer sides of the ring. When connected together, the partial segments form, under a circumferential and radial pressure which is approximately uniform when the turbomachine is in operation at the design point, a self-supporting inner ring.

The delimiting surface of any one partial segment has, facing the inner circumferential surface of the outer ring, a surface having a substantially planar, concave, convex or nodular profile, wherein the partial segment itself can consist of a single material of monolithic construction or of a plurality of composite materials having different dimensions or compositions. The material, or the composite materials, used for this for forming such a partial segment have a uniform and/or non-uniform micro structure.

The partial segment formed in this manner has, depending on the load ranges of the turbomachine, a predetermined stress and/or expansion behavior. This expansion behavior of the partial segments can be configured differently in the radial and/or axial direction by means of a differentiated construction, in correlation with the different temperatures which prevail in the radial and axial direction of the partial segment.

According to one embodiment, the stator component for a turbomachine consists substantially of at least one axial outer ring and one inner ring, wherein the outer ring serves as a holder for the inner ring consisting of partial segments and wherein the partial segments are arranged with respect to one another such that, in the installed state, they form a circular inner ring on the rotor side facing the rotational movement of rotor blades. In this context, the partial segments consist of a material of uniform construction or of a material constructed at least gradually in the radial direction or at least in the radial direction of a plurality of partial bodies constructed of different materials. The partial segments formed in this manner are heated when the turbomachine is in operation, depending on the load ranges of the turbomachine, such that there results a temperature gradient from radially inwards to outwards, wherein the material layering in the partial segments is chosen such that the inner materials have a smaller coefficient of expansion than the outer materials, such that the compressive stress resulting from the expansion of the partial segments in the circumferential direction between partial segments in the inner ring adopts a predetermined stress profile.

In a further embodiment, the partial segments abut against one another in the circumferential direction, forming a tapered gap, wherein the spacing in the gap is kept such that, in operation, the temperature gradient between the adjacent partial segments produces a force fit which now leads to a predetermined profile of the compressive stress between the partial segments over the entire radial expansion or else only over radial sections of the partial segments.

In yet another embodiment, an interlocking portion being formed, the partial segments engage in one another in the circumferential direction, wherein the interlocking portion is spaced apart in the radial direction such that, in operation, the temperature gradient between the adjacent partial segments produces a force fit which leads to a predetermined profile of the compressive stress between partial segments over the entire radial expansion or else only over radial sections of the partial segments.

In a further embodiment, the material layering in the partial segments is chosen such that the inner materials have a smaller coefficient of expansion than the outer materials, such that the expansion of the partial segments in the circumferential direction, in combination with a tapered gap in the circumferential direction between partial segments in abutment against one another, or in combination with an in the radial direction with a spaced-apart interlocking portion partial segments engaging in one another, produces a predetermined profile of the compressive stress between the partial segments.

A predetermined profile of the compressive stress can be a uniform radial pressure or a practically constant pressure profile. This is for example a pressure profile which deviates by not more than 20% of the average value of the stress over at least 80% of the surface at which the partial segments abut against one another.

The principal advantage of the invention lies in the fact that the partial segment formed as an element consists substantially of a ceramic material which adopts a qualitatively and quantitatively different behavior with respect to the stress values and expansion values, depending on its operation use, in particular during the transient load ranges of the turbomachine up to full operation.

In order to achieve this aim, the ceramic partial segment is produced such that it has a uniform or gradually constructed material structure which permits a different expansion behavior and stress behavior depending on the operation.

Moreover, the materials of the respective material structure or partial structure of the partial segment have chemical and physical properties which are required for operation in order to, for example, ensure the required strength and loadability of the elements when in operation.

The partial segment can also consist of various partial bodies incorporated into one another, which are in each case constructed of ceramic materials having different chemical and physical properties.

The incorporated partial bodies for forming a partial segment can also have material structures which differ from one another and which produce a certain physical effect in certain operational states.

A particularly important behavior of such a partial segment relates to the expansion behavior in various operational states of the turbomachine, which are in operative connection with the rotor blades operating there of the turbomachine with respect to the self-setting gap size.

Therefore, when the ceramic partial segment has an operation-dependent expansion behavior and a strength variability or a safety behavior against the thermal loads, the operational safety of the entire turbomachine is maximized.

Furthermore, an operation-dependent expansion behavior of the ceramic element also has a positive effect on the efficiency of the turbomachine, in that for example the blade tip losses in the stator/rotor blades region can be minimized.

In principle, an element (partial segment) made of ceramic materials is preferably used as a heat shield, in particular when the turbomachine is a gas turbine, as ceramic materials are generally very heat-resistant materials.

In the case of such a joint direction, the ceramic element can also simply consist of a ceramic fraction, while the remaining fractions can consist of less heat-resistant materials. Depending on which expansion behavior or stress behavior such a partial segment must conform to, it is possible to design one behavior to reinforce or counteract the other behavior, within permissible limits.

To the extent that the operational ratios allow, the expansion behavior can be generated only through those material fractions of the element used which, on account of their chemical and physical properties, offer the best results.

The body prepared as an element, that is to say as a partial segment, can be produced by sintering from a compressed ceramic powder, which allows a high variability in the choice of material. In this manner, the composition of the element can be varied so as to work on various chemical and physical properties of the final material, i.e. inter alia the porosity, hardness, thermal conductivity, or other mechanical, electrical, thermal and/or magnetic properties.

In addition, the ceramic element can also, considered macroscopically, be of solid construction or consist of various partial bodies, also of macroscopic construction, the joining together of which produce a secure connection.

Furthermore, the element can also contain targeted structural cavities which can fulfill various tasks. On one hand, these cavities can be used for internal cooling of the ceramic or quasi-ceramic element, wherein this cooling can also be driven such that at least its expansion behavior is dynamically influenced. On the other hand, these cavities can also be arranged such that they themselves produce a degree of suitable expansion behavior. A combination of these two structures for a new final purpose is also possible.

The ceramic or quasi-ceramic element bears, on its rotor side, preferably an abrasion-compatible layer which is generally formed facing the rotor blades as a sealing and wear layer. A good seal is preferably then achieved when this wear layer has those properties which correspond to a rubbing layer. This is the case if the wear layer, on account of the rotor blade tip rubbing because of expansion, allows notches or cavities, which at least in normal operation of the turbomachine achieve maximum sealing between the blade tip and the element.

Regardless of the possibility of such abrasion-compatible layers being provided on the end side of the element, the invention here aims, when this is the issue, to ensure a maximized seal, in that the expansion behavior of the element is supported in dependence on the expansion of the rotor or of the rotor blades by internal material dispositions which in addition support the described effect of the abrasion-compatible layer.

As far as the form-related design of the ceramic or quasi-ceramic element is concerned, its corporeal expansion is preferably configured such that it forms a narrowly delimited sector of the entire ring. The rotor-side inner ring is preferably formed by a number of elements which are preferably of identical shape and size, and have a thickness of 3-8 cm in the radial direction. In the circumferential direction, the elements have for example an arc angle of 10-15°, whereby the entire ring then consists of 24 to 36 individual partial segments.

The respective ceramic or quasi-ceramic element then preferably has in the radial direction (in the installed state in a section perpendicular to the axis of rotation of the turbomachine) the shape of a trapezium or a quasi-trapezium, which then has a positive effect on the requirement for a self-supporting structure in connection with the outer ring. Irrespective of the underlying geometric shape of the partial segment, the rotor-side circumferential surface formed by the partial segments will form a cohesive circular surface for the rotor blades of the turbomachine rotating past it there.

As already presented above, the rotor-side inner ring, formed by the elements, can in principle consist entirely of a ceramic material. In some cases, compositions can also consist of 70% or more, by weight or by volume, of a ceramic material, and the remainder to 100%, depending on the predetermined expansion behavior and stress behavior, can consist of other materials, the compatibility of which must be determined in relation to the final properties of such an element. Therefore, if the element does not consist entirely of a ceramic material, the present description frequently refers to quasi-ceramic elements.

The described stator component can in principle extend, as a ring, in the axial direction of the turbomachine operatively over all the stages of the rotor blades. It is also possible to provide the inner ring consisting of the partial segments in the axial direction only in the region of the operating rotor blades.

Furthermore, it can be arranged that, at different stages, the material-related composition of the partial segments is matched in a corresponding manner depending on a determined expansion and strength behavior.

In general, the ceramic or quasi-ceramic elements are encompassed in the radial extent by an outer metal ring which ensures the stability of the individual elements in the composite unit. This stability is most important in order that, in operation, the individual elements become a cohesive solid body.

Facing the inner circumferential surface of the metal ring, these elements can have a concave or convex matching shape, which ensures that the positioning of these elements with respect to the metal ring, in particular during the assembly, also produces a form fit.

The ceramic or quasi-ceramic elements can also, as already briefly indicated above, have intermediate excavations through which a cooling medium can be made to flow as required. To that end, grooves can be provided, for example in the region of the radially running boundary surface to the side of the individual elements positioned next to one another, which on one hand do reduce the active abutment surface between two adjacent elements, but on the other hand contribute to establishing a defined, more complete form-fitting abutment surface between the elements with respect to one another. These radial grooves can also be used as cooling channels, the cooling of which acts at least in the region of the elements bordering one another. This option can also serve to influence, in a targeted manner, the expansion behavior of the elements in certain operational states of the turbomachine. The individual elements should in all cases be brought together so as to form a ring in which the abutment surfaces of the adjacent elements form a gas-tight or almost gas-tight connection, in particular when the turbomachine is in operation.

The fit in the stator component between the outer ring and the inner ring formed from the partial segments will generally aim for at least a form fit during assembly, although configured with an initially minimized force-fit component, wherein the initial force fit will increase in operation and must be configured such that a maximum permissible compressive stress between the individual elements is not exceeded.

However, it is readily possible, for certain configuration types, to provide the elements such that, in operation, they can become a material-bonded or quasi-material-bonded fit, wherein for safety reasons, if this is the case, the quasi-material-bonded fit is suitable for use.

As far as the ceramic used for the partial segments is concerned, this can consist of zirconium oxides, aluminum oxides, magnesium oxides, wherein the partial segment or sections thereof can be composed of different fractions of various ceramics.

With regard to the stress and expansion behavior of the partial segment, the rotor-side surface has, on account of the thickness ratios, the temperature dependency of the coefficients of thermal expansion and the stiffness of all materials, a compressive stress of greater than zero MPa to 500 MPa for all operational temperatures, whereby the partial segment can cover the entire operational load range of the turbomachine. The compressive stress of the partial segments with respect to one another when first installed is preferably limited to up to 50 MPa, which on one hand leads to a complete form fit and on the other hand represents enough of a stress reserve for full operation.

The materials are layered such that the materials on the radially inner side of the inner ring have the smallest coefficients of thermal expansion and that this increases outwards. The ratios of the coefficients of expansion are chosen, from inside to outside, such that the product of coefficient of expansion and temperature increase from cold installation and hot operation remains constant or practically constant for all radial positions. Practically constant is to be understood for example as deviations from a constant value which do not lead to more than a 20% difference between local compressive stresses in the circumferential direction with respect to an average compressive stress in the form fit. Edge regions or local flaws in the form fit can thus naturally lead to higher deviations. In a further embodiment, in particular for rings having a large ratio of ring height to ring diameter (e.g. ring height to ring diameter greater than 0.1, in particular greater than 0.2), the ratios of the coefficients of expansion are chosen, from inside to outside, such that the product of coefficient of expansion, circumference and temperature increase from cold installation and hot operation remains constant or practically constant for all radial positions.

The adjacent partial segments can also have between one another an interlocking surface which, in the installed state, leads in the radial profile to a labyrinthine seal. In the case of such a configuration, it is necessary to provide that the different expansion behavior of the adjacent partial segments with respect to one another, both in the radial direction and in the circumferential direction, during startup and in operation, is taken into account by corresponding initial disposition of the gap size along the labyrinth formed in this manner. The gap size can thus decrease in the radial direction of the partial segments, wherein in this context the gap size, that is to say the spacing between the adjacent partial segments, experiences an expansion-related overlayering, in particular if the ceramic or quasi-ceramic element consists in the radial direction of various layers or partial bodies of different material composition, for example with respect to porosity, particle size, chemical composition etc.

BRIEF DESCRIPTION OF THE DRAWINGS

All elements which are not essential for the immediate comprehension of the invention have been omitted. Identical elements have been provided with the same reference signs in the various figures, in which.

DETAILED DESCRIPTION

Figure 1:
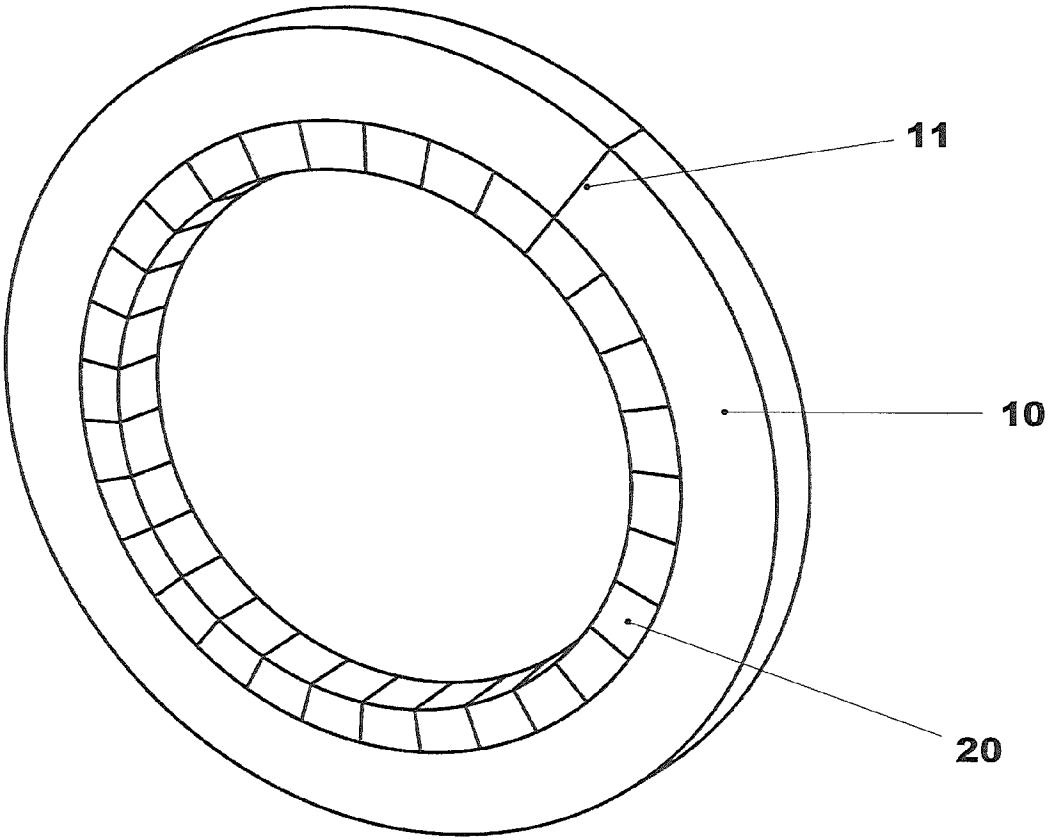
FIG. 1 is a representation of a stator component consisting of a cohesive outer ring and an inner ring consisting of partial segments.

FIG. 1 shows a schematic representation of a metal ring 10 which, in the region of the individual partial elements 20, also referred to as partial segments, forms as a ring a part of the stator. In this context, this outer ring 10 can be segmented 11 one or more times in order to better bind the partial elements 20 assembled in a ring shape. A cohesive outer ring 10 is also not excluded per se. However, this requires that the installation of the partial segments 20 is ensured by means of precautions when inserting the last partial segment. In principle, the outer ring 10 consists of a metallic material while the partial segments 20 consist at least in part of ceramic materials. The outer rings 10 can be disposed in the axial direction of the stator such that they are merely in operative connection with a rotor blade row.

The compressive stress of the partial segments with respect to one another when first installed is preferably limited to a maximum of 50 MPa, which on one hand leads to a complete form fit and on the other hand represents enough of a stress reserve upwards for full operation.

With regard to the stress and expansion behavior of the partial segment, the rotor-side surface has, on account of the thickness ratios, the temperature dependency of the coefficients of thermal expansion and the stiffness of all materials, a compressive stress of greater than zero MPa to 500 MPa for all operational temperatures, whereby the partial segment can cover the entire operational load range of the turbomachine.

Figure 2:
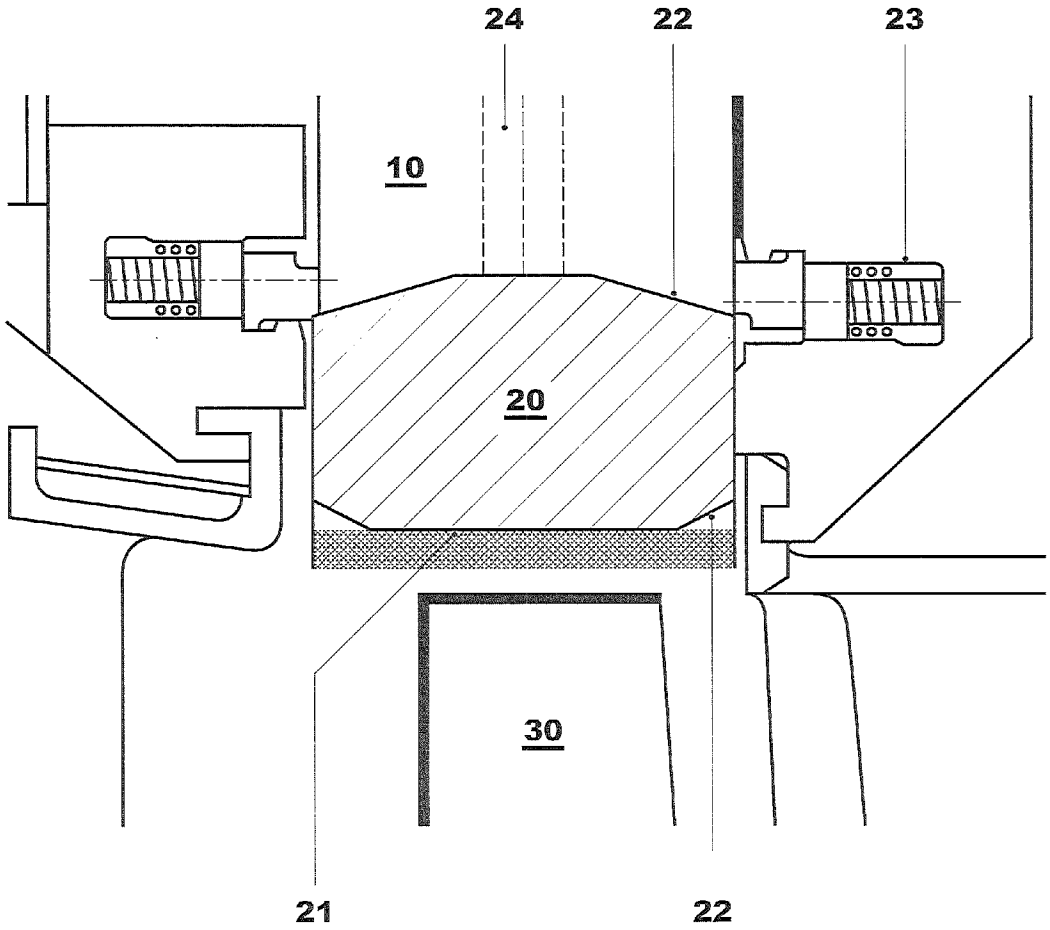
FIG. 2 is a representation of a section through a stator component in a radial section.

FIG. 2 shows a schematic representation of a section of the stator component in the region of the partial segment 20. The element represented in FIG. 2, formed from a ceramic or quasi-ceramic material, forms a part of a cohesive inner ring which is particularly obvious in FIG. 1.

The partial segment 20 is represented here in the sense of a body of uniform construction. This uniform body can consist of a uniform material or of various materials which, for example, can be fused by sintering into a monolithic body. The body thus sintered can then have desired and predefined gradually changing chemical and physical properties. This is however not obligatory per se, since the partial segment can also, at least in the radial direction, consist of a number of partial bodies which, between themselves, can also consist of different materials having different material structures, with the final purpose that the stress and expansion behavior of the inner ring fulfills predetermined values in operation. Thereafter, such variations can readily also relate to the partial segment in the axial direction.

It is furthermore not obligatory that the entire partial segment 20 consist wholly of ceramic materials: configurations can readily be provided in which the integration of metallic fractions can be expedient specifically for predetermining the stress and expansion behavior. The geometric embodiment of the partial segment 20 has, at least in the radial direction, a polygonal shape which, on the corner side, deviates from a rectangular shape. This is preferably provided insofar as the stress-critical edges 22 of the partial segment 20 thereby experience a substantial load reduction in the installed state. In the region of the radial expansion of the partial segments, seal elements are provided between the outer diameter of the outer ring and the inner diameter of the inner ring and altogether prevent a radial flow of the working medium from the main flow duct into the stator.

These seal elements are components of positioning elements 23 which act on the partial segment 20 and ensure that the expansions can be taken up at least axially between partial segments and outer ring. By virtue of the seal element then being a component of this dynamic positioning element 23, the active effect of the seal element in operation is maximized.

These seal elements are arranged in the region of each partial segment, on both sides thereof and in the circumferential direction. The rotor-side surface of the partial segment has an abradable layer 21 which, in certain operational configurations of the turbomachine, contributes to the fact that, by active abrasion of this layer by the tip of the rotor blade 30 rotating past it there, the gap between partial segment and blade tip is minimized and thus the blade tip losses are minimized. Furthermore, a feed duct 24, by means of which a coolant is brought to the partial segments 20, passes through the outer ring 10.

Figure 3:
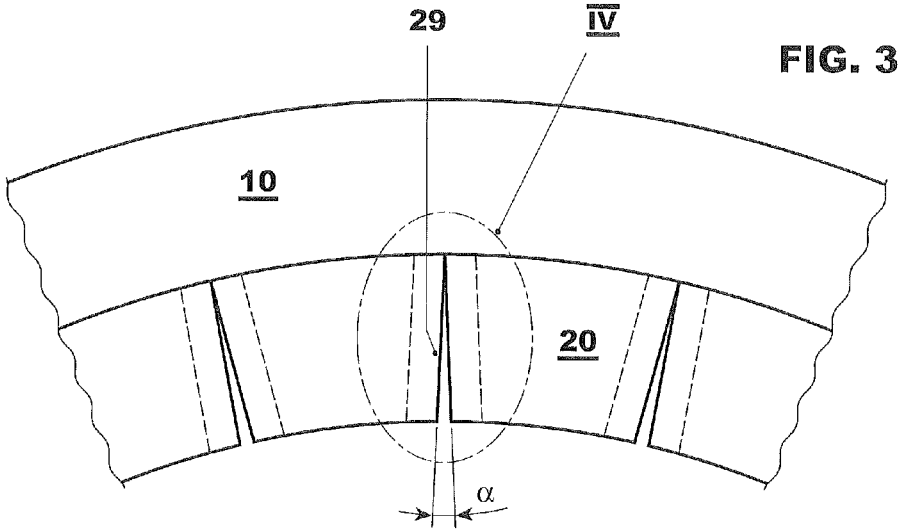
FIG. 3 shows partial segments which are spaced apart from one another.
Figure 4:
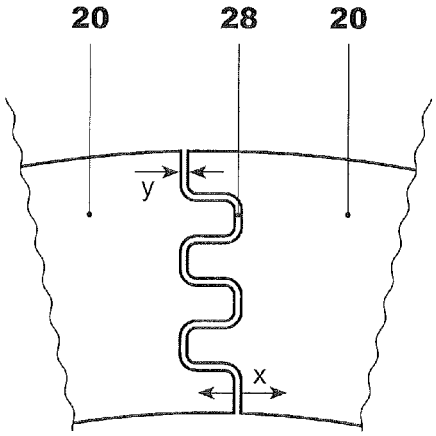
FIG. 4 shows a labyrinthine spacing between adjacent partial segments.

FIGS. 3 and 4 show an alternative in the bringing together of adjacent partial segments, in the sense that, as here in the case of the installation, no immediate form fit or force fit is established, rather the partial segments in the circumferential direction, forming a tapered gap 29, abut against one another more or less loosely. This gap 25 runs pointedly in the radial direction, wherein the angle $\alpha$ is between 5° and 30°. The basic concept behind this form is the fact that the expansions decrease in the radial direction as a consequence of the temperature profile, such that the spacing must be made to be greater on the inside than on the outside. The gap formed can be formed, as in FIG. 3, over the entire radial extent of the partial segment. However, it is also conceivable for the gap to be present over only part of the radial extent. The gap is preferably formed in the rotor-side region of the partial segment. The gap can be straight or curved. The spacing is kept such that, in operation, a force fit results between the adjacent partial segments, which force fit leads, over the entire radial expansion or also only over radial sections of the partial segments, to a predefined profile of the compressive stress. In one embodiment, the compressive stress will result uniform or approximately uniform.

FIG. 4, as a view of the circular surface of the inner ring, then shows how an interlocking portion of the two adjacent partial segments 20 can be brought about, in that a labyrinth profile is achieved which prevents the throughflow of the hot working gases between the partial segments. The spacing is held such that, in operation, there results between the adjacent partial segments a force fit which is now approximately uniform over the entire radial expansion or also only over radial sections of the partial segments, in that specifically an initially different gap size is provided, as is characterized by the arrows X and Y. In a labyrinth embodiment, it is not necessary for a force fit to be present everywhere, as the form fit of the labyrinth itself provides the seal. When the parts are in the cold state, so for example during installation in a gas turbine, a form fit typically results only locally. When the parts are heated in operation and thus expand, they are pressed into one another in the circumferential direction. The form fit thus improves and a force fit develops.

If now the partial segment 20 in the radial direction is composed of various materials having different coefficients of expansion, this must be taken into account accordingly when configuring the gap size 28, in order that the desired force fit in operation along the adjacent partial segments is achieved. In summary, it can therefore be said that this expansion behavior of the partial segments in the radial direction can be weightily influenced also by means of a differentiated construction, this in correlation with the different temperatures which naturally prevail in the radial direction of the partial segment. It is also the case with such an installation that the compressive stress in operation should not be greater than 500 MPa.

Figure 6:
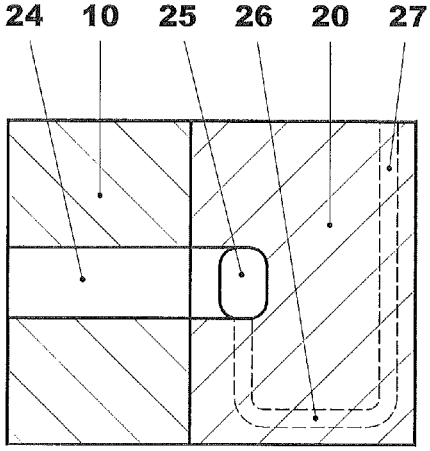
FIG. 5*a* shows a further configuration relating to the cooling of the partial segments and FIG. 6 shows an outlet configuration of the coolant from the partial segment.
Figure 5:
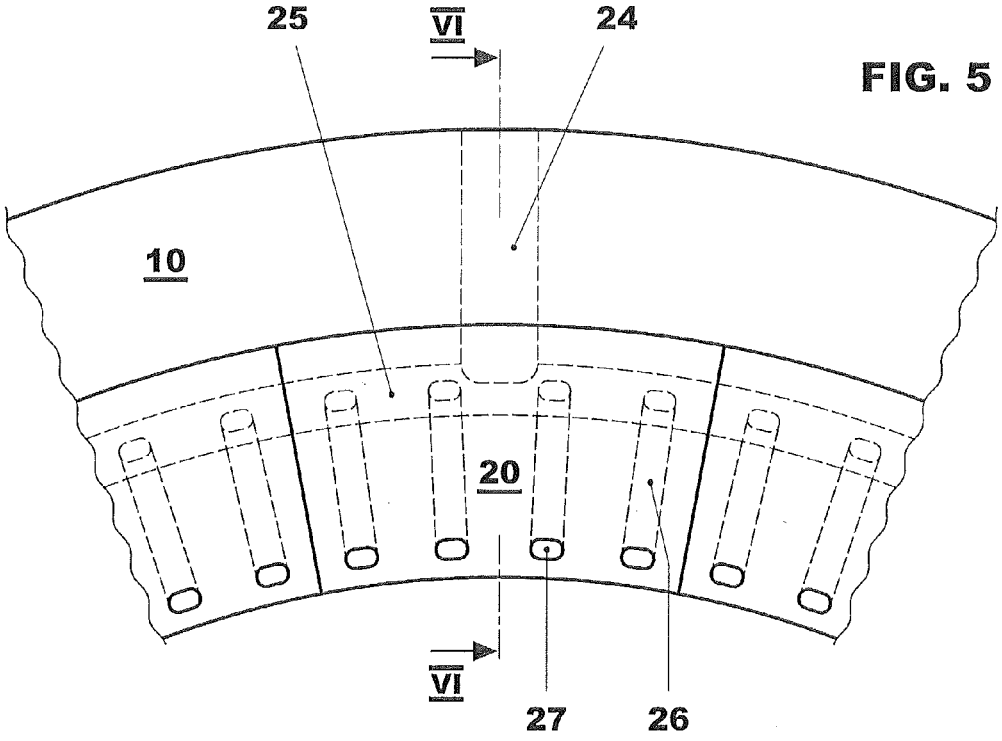
FIG. 5 shows a configuration relating to the cooling of the partial segments.
Figure 5A:
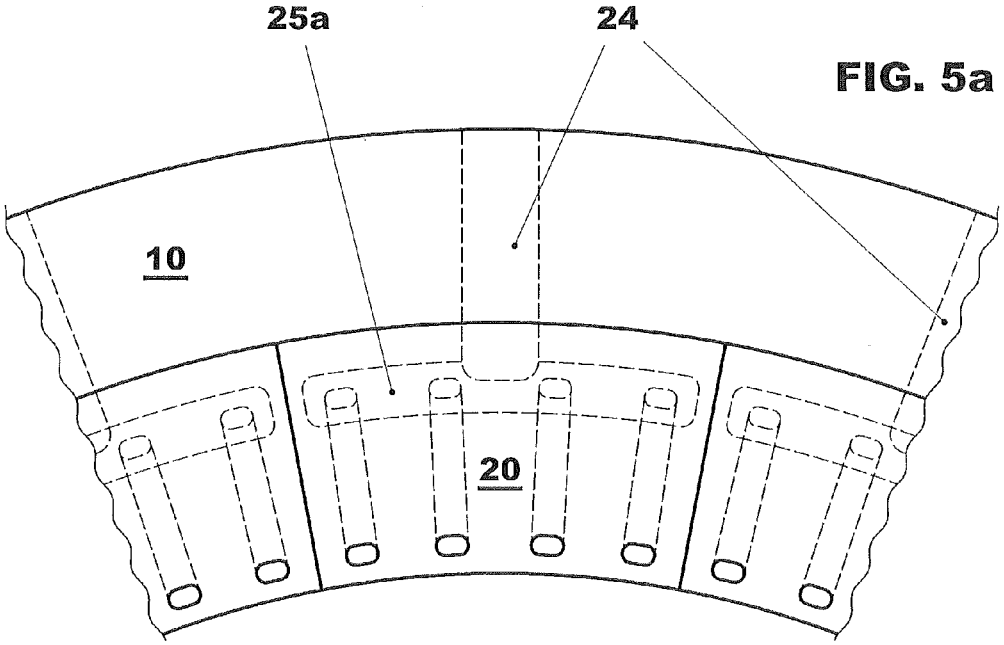

FIG. 5, FIGS. 5*a* and 6 show a possible cooling configuration of the partial segments proceeding from the coolant feed duct 24. The partial segment 20 then has, in the circumferential direction, an inner cohesive chamber 25 which is in operative connection with the feed duct 24 and is above all partial segments 20, from which chamber angled flow ducts 26 branch off, which ducts ensure integral cooling of the partial segment. The cooling medium is then guided outwards via the extension 27 provided for every flow duct 26. FIG. 5*a* shows that the chamber 25*a* is in each case disposed for just one partial segment 20, such that a corresponding number of feed ducts 24 must be provided.

Not shown in more detail in FIGS. 5 and 6, grooves can also be provided in the region of the radially running boundary surface to the side of the individual partial segments 20 positioned next to one another, which on one hand do reduce the active abutment surface between two adjacent elements, but on the other hand contribute to establishing a defined, more complete form-fitting abutment surface between the elements with respect to one another. These radial grooves, not shown in more detail in the figures, can also be used as cooling channels, the cooling of which works at least in the region of the partial segments bordering one another. This option can also serve to influence, in a targeted manner, the expansion behavior of the partial segments with respect to one another in certain operational states of the turbomachine.

The individual partial segments should in all cases be able to be brought together so as to form a ring, such that the abutment surfaces of the adjacent elements form a gas-tight connection, in particular when the turbomachine is in operation, and furthermore leads to a compressive stress not greater than 500 MPa.

The invention claimed is:

1. A stator component for a turbomachine, consisting substantially of at least one axial outer ring and one inner ring, wherein the outer ring serves as a holder for the inner ring consisting of partial segments, wherein the partial segments are arranged with respect to one another such that, in an installed state, the partial segments form a circular inner ring on a rotor side facing a rotational movement of rotor blades, wherein the partial segments consist of one of a material of uniform construction or a material constructed at least gradually in a radial direction or at least in the radial direction of a plurality of partial bodies constructed of different materials, and the partial segments formed in this manner are heated when the turbomachine is in operation, depending on load ranges of the turbomachine, such that a temperature gradient from radially inwards to outwards results, wherein the partial segments abut against one another in a circumferential direction, forming a tapered gap, wherein the gap is narrowing in a radially outward direction, wherein spacing in the gap is kept such that, in operation, a temperature gradient between the adjacent partial segments produces a force fit which leads to a predetermined profile of compressive stress between the partial segments over an entire radial expansion or only over radial sections of the partial segments.

2. The stator component as claimed in claim 1, wherein the predetermined profile of the compressive stress is of identical shape or practically constant or deviates by not more than 20% of an average value of the stress over at least 80% of a surface at which the partial segments abut against one another.

3. The stator component as claimed in claim 1, wherein the partial segment consists entirely or partially of a ceramic material.

4. The stator component as claimed in claim 3, wherein the partial segment consists of at least 70% by weight or by volume of ceramic.

5. The stator component as claimed in claim 4, wherein the ceramic material is constructed substantially of at least one of zirconium oxides, aluminum oxides, and magnesium oxides.

6. The stator component as claimed in claim 5, wherein the oxides consist of 50-100% by weight or by volume.

7. The stator component as claimed in claim 1, wherein the partial segment consists, in the axial direction or in the circumferential direction of the inner ring, of a plurality of partial bodies constructed of different materials.

8. The stator component as claimed in claim 1, wherein the outer ring consists entirely or partially of a metallic material.

9. The stator component as claimed in claim 1, wherein the outer ring of the stator component is constructed in a single piece or in a plurality of pieces.

10. The stator component as claimed in claim 1, wherein the at least one partial segment is, at least in the radial direction, prismatic or quasi-prismatic in shape and has, facing the inner circumferential surface of the outer ring, a surface having a substantially planar, concave, convex or nodular profile.

11. The stator component as claimed in claim 1, wherein the partial segments slotted together to form a composite unit establish a form fit, a frictional connection or a material-bonded fit in at least one of the circumferential direction and in the radial direction.

12. The stator component as claimed in claim 11, wherein the installation of the partial segments to form the inner ring by means of a force fit is such that the force fit between the adjacent partial segments is provided with a compressive stress greater than zero and less than 50 MPa.

13. The stator component as claimed in claim 12, wherein, in operation, the force fit between the individual partial segments has a compressive stress of up to 500 MPa.

14. The stator component as claimed in claim 11, wherein the installation of the partial segments to form the inner ring by means of a form fit is such that, in operation, the form fit becomes a force fit.

15. The stator component as claimed in claim 11, wherein the installation of the partial segments to form the inner ring by means of a form fit is such that the form fit has a labyrinth fit oriented axially or quasi-axially.

16. The stator component as claimed in claim 15, wherein the labyrinth fit between the adjacent partial segments has, at least in the radial direction, a decreasing spacing.

17. The stator component as claimed in claim 1, wherein at least one seal element is installed in the radial direction between the outer diameter of the outer ring and the inner diameter of the inner ring.

18. The stator component as claimed in claim 17, wherein the at least one seal element extends on either side of and in the circumferential direction of the stator component.

19. The stator component as claimed in claim 1, wherein the partial segment has on the rotor side an abradable layer.

20. The stator component as claimed in claim 1, wherein the partial segment has internal throughflow ducts through which a coolant flows.

21. The stator component as claimed in claim 1, wherein material layering in the partial segments is chosen such that inner materials have a smaller coefficient of expansion than outer materials, such that the compressive stress resulting from an expansion of the partial segments in the circumferential direction between partial segments in the inner ring adopts a predetermined stress profile.

22. The stator component as claimed in claim 1, wherein a material layering in the partial segments is chosen such that the inner materials have a smaller coefficient of expansion than the outer materials, such that the expansion of the partial segments in the circumferential direction, in combination with the tapered gap in the circumferential direction between partial segments in abutment against one another produces a predetermined profile of the compressive stress between the partial segments.

* * * * *